United States Patent [19]

Shaw et al.

[11] Patent Number: 4,942,740

[45] Date of Patent: Jul. 24, 1990

[54] AIR CONDITIONING AND METHOD OF DEHUMIDIFIER CONTROL

[75] Inventors: Allan Shaw; Russell E. Luxton, both of 5th Floor, Security House, 233 North Terrace, Adelaide, Australia; Russell E. Luxton, both of Adelaide, Australia

[73] Assignees: Allan Shaw; Russell Estcourt Luxton; Luminis Pty. Ltd., all of Adelaide, Australia

[21] Appl. No.: 319,409

[22] Filed: Mar. 3, 1989

Related U.S. Application Data

[63] Continuation-in-part of Ser. No. 124,876, Nov. 24, 1987, Pat. No. 4,876,858.

[30] Foreign Application Priority Data

Nov. 24, 1986 [AU] Australia ..... PH 9126

[51] Int. Cl.[5] ..... F25D 17/06

[52] U.S. Cl. ..... 62/93; 62/199; 62/223; 165/35

[58] Field of Search ..... 62/93, 117, 223, 199, 62/185, 175; 236/1 EA; 165/35

[56] References Cited

U.S. PATENT DOCUMENTS

| | | | |
|---|---|---|---|
| 2,021,090 | 11/1935 | Ringquist | 62/93 |
| 2,205,117 | 6/1940 | Chambers | 165/35 X |
| 2,614,394 | 10/1952 | McGrath | 62/3 |
| 2,960,840 | 11/1960 | Hosken et al. | 62/81 |
| 3,069,867 | 12/1962 | Ringquist | 62/159 |
| 4,259,847 | 4/1981 | Pearse, Jr. | 62/93 |
| 4,319,461 | 3/1982 | Shaw | 62/93 |

OTHER PUBLICATIONS

Shaw, "Airstream Velocity Across Dehumidifers," Proceedings of the 7th International Heat Transfer Conference, Munich, vol. 6, (5 Pages) (Aug. 1982).

Shaw et al., "Latest Findings . . . Through Dehumidifier Coils", Third Australasian Conference on Heat and Mass Transfer, (8 pages) (1985).

Shaw et al., "High Quality . . . Energy Consumption," Far East Conference on Air Conditioning in Hot Climates, Singapore, pp. 155–161 (Sep. 1987).

ASHRAE Handbook Fundamentals, p. 4.7 (1985).

Tamblyn, "Beating the Blahs for VAV", ASHRAE Journal, pp. 42–45 (Sep. 1983).

Gupta et al., "Variable Air Volume Forum," ASHRAE Journal, pp. 22–31 (Aug. 1987).

Shaw, "Exploration of Air Velocity . . . Conservation Project," ASHRAE Transactions, 15 Pages (1982).

Luxton et al., "An Assessment . . . Energy Cost Savings," 4th Asean Energy Conference–Energy Technology, Singapore, (15 Pages) (Nov. 1987).

Refrigeration and Air Conditioning Text, 2d Ed., Air–Conditioning & Refrigeration Institute, Prentice–Hall (1987).

*Primary Examiner*—William E. Wayner

*Attorney, Agent, or Firm*—Baker, Maxham, Jester & Meador

[57] ABSTRACT

An air conditioner dehumidifier comprising coil portions cooled by a fluid coolant such as by chilled water or refrigerant. As the required air sensible and latent cooling demands and their ratio varies in the conditioned space, the number of operational coil portions and the velocity of the coolant flow through each is controlled, by valves or other means, increasing coolant velocity while reducing the number of operational coil portions and vice-versa, to provide the coil surface area and the coil surface temperature necessary to cause the required degree of dehumidification and the required degree of sensible cooling in the required ratio to maintain comfortable conditions in the conditioned space with low energy consumption at all cooling demands.

26 Claims, 10 Drawing Sheets

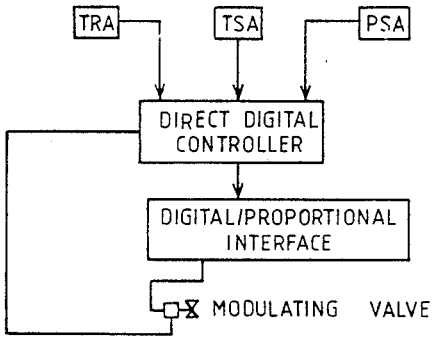
FIG.6a
LEGEND
TSA - SUPPLY AIR TEMPERATURE
TRA - RETURN AIR TEMPERATURE
PSA - SUPPLY AIR PRESSURE
TSA STPT - SUPPLY AIR SETPOINT
V - CHILLED WATER VALVE
ΔTDG - RETURN DUCT DRY BULB TEMPERATURE GAIN
CHANGE% - % SENSIBLE PEAK LOAD AT WHICH CHANGEOVER SET TO OCCUR.
QRSH - FURTHER ROOM SENSIBLE HEAT
FIG.6b
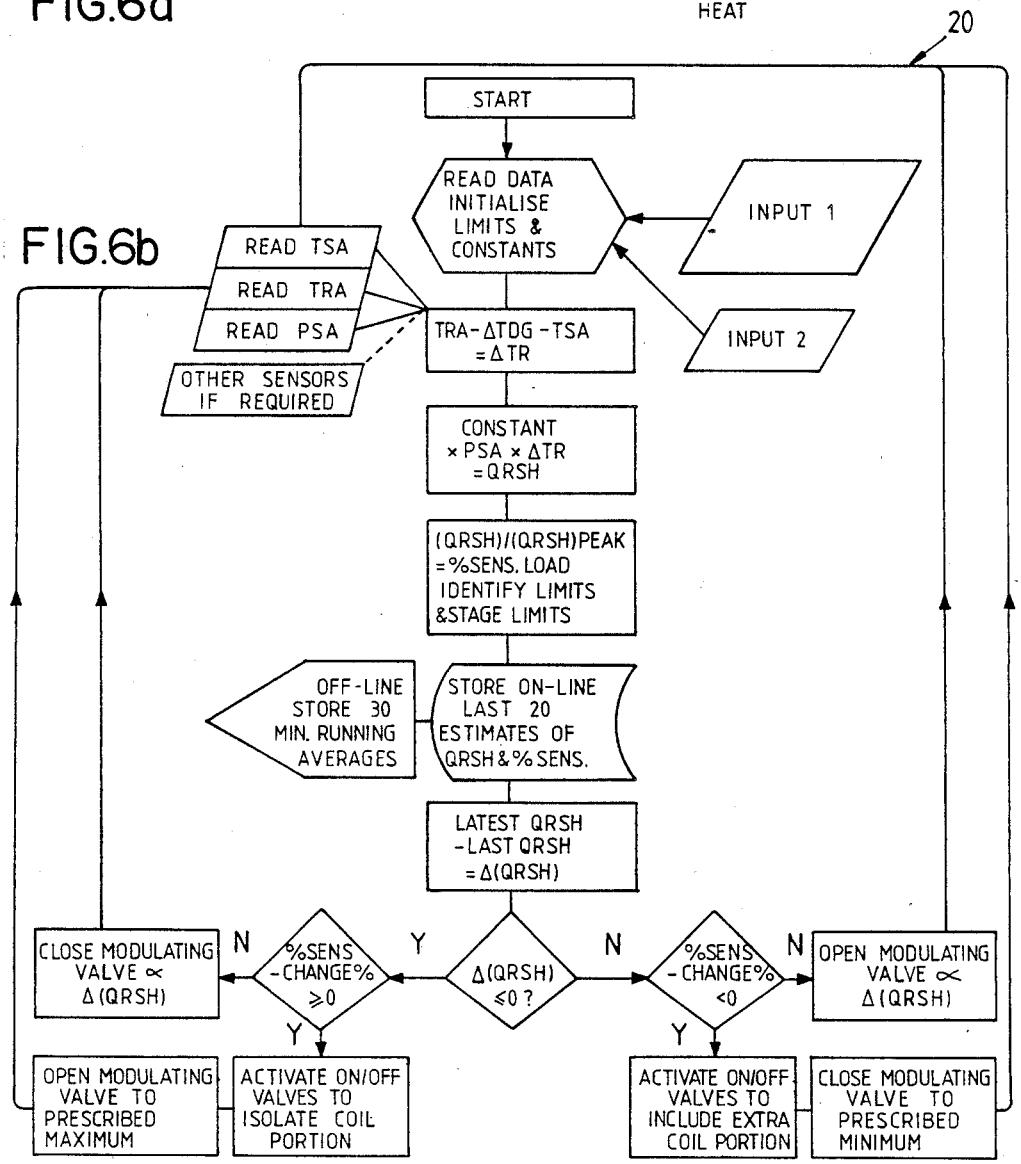

AIR CONDITIONING AND METHOD OF DEHUMIDIFIER CONTROL

CROSS REFERENCE TO RELATES APPLICATION

This is a continuation-in-part of application Ser. No. 07/124,876, filed Nov. 24, 1987, now U.S. Pat. No. 4,876,858.

This invention relates to a new air conditioner and a new comprehensive method of air conditioning wherein a dehumidifier is controlled over varying load conditions to satisfy both sensible and latent heat loads at peak load and all part load conditions. Low energy consumption, low noise level and improved performance are the major benefits.

BACKGROUND TO THE INVENTION

Numerous problems have arisen for both constant air volume and variable air volume systems due to the efforts to reduce the operating cost, reduce the capital cost of installations and reduce the space requirements for the air conditioning systems. While some of these problems have been successfully resolved, others have been solved by means which have largely nullified the original design objectives and frequently degraded performance to an unacceptable level, especially in offsetting latent heat loads.

In addressing the imposed loads the design of costeffective quality air conditioning systems requires, inter alia, consideration of (i) Coolant flow rate and air flow rate,
(ii) Dehumidifier size,
(iii) Secondary to primary surface area ratio,
(iv) Performance at all potential operating conditions,
(v) System noise levels.

In this specification, consideration is given to:

(a) Range of load
(b) Segments of that range
(c) Stages of effective dehumidification These requirements are referred to hereunder in detail:

(i) Coolant Flow Rate and Air Flow Rate

The flow rate of coolant influences part load performance in all environments. The higher the coolant velocity within the tubes of the dehumidifier, all other parameters being held constant, the steeper is the coil condition curve on a psychrometric chart; that is, the greater is the ratio of latent cooling (moisture removal) to sensible cooling.

Conventionally, whether the air conditioning system is a constant air volume (CAV) system or a variable air volume (VAV) system, it is common practice to effect control by reducing the volume flow rate of coolant through the tubes of the dehumidifier coil as the cooling requirement reduces. This reduces the cooling capacity of the coil but also reduces the ratio of the latent to sensible cooling by reducing the coolant-side heat transfer coefficient, itself a function of coolant flow velocity, so raising the coil surface temperature, hereinafter referred to as the interface temperature.

During part load weather conditions the transmission of sensible heat from the external environment to the treated zone reduces, or may actually become negative and so canoel part of the internal sensible heat load. However latent heat addition (from people, infiltration and other sources) which occurs simultaneously and in parallel with the sensible transfer, will usually remain the same or may increase It is quite common to have a part load condition wherein the ambient dry bulb temperature is lower and the dew point temperature is higher than at design peak conditions. Thus there is a decreased sensible heat load and an increased latent heat load. The dehumidifier must then operate at a new ratio of latent to sensible heat transfer and hence the slope of the coil condition curve is required to be steeper.

Whether the system be constant air volume (CAV) or a variable air volume (VAV) the velocity of the airstream entering the face of the dehumidifier coil, hereinafter referred to as the face velocity, influences performance. The lower the face velocity, all other parameters including mass flow of air being held constant, the lower is the air-side heat transfer coefficient, the lower is the coil surface (interface) temperature, the greater is the amount of moisture removal per unit mass flow of air, the greater is the ratio of latent to sensible cooling and hence the steeper and straighter is the coil condition curve.

(a) Conventional Coolant Flow Rate for Constant Air Volume (CAV) Systems

In constant air volume systems the conventional face velocity does not vary with the load. A reduced load is offset by throttling the coolant flow to the dehumidifier. As a result of the decrease in heat transfer rate due to reduced coolant flow, which for a given coolant circuit arrangement and series connection of all coil portions is synonymous With reduced coolant velooity, the air temperature leaving the dehumidifier rises with throttling of the coolant flow. This can only be a satisfactory means of accommodating reduced loads if the zone latent heat loads are small and the ambient air at part load is dry.

Otherwise, the reduced coolant flow allows the interface temperature to rise as a result of the decrease in coolant-side heat transfer coefficient, which in turn reduces the rate of moisture removal from the air and causes the slope of the coil condition curve to decrease such that the ratio of latent to sensible heat transfer decreases below that for full load. To satisfy the ratio required for a particular part load condition the dew point of the air entering the dehumidifier must increase to provide a sufficient difference from the interface temperature to cause condensation to occur at the required rate. This in turn requires that the humidity ratio in the conditioned space must rise. Often the level to which it rises is unacceptable to the occupants of the space. As the throttling of the coolant proceeds, the humidity ratio of the air leaving the dehumidifier rises progressively. However, it has already been established that during part load for a given entry condition a steeper coil condition curve is required to accommodate the increased ratio of the latent to the sensible heat load. It is evident also that in climates having high humid peak load conditions steep coil condition curves are required.

(b) Coolant Flow Rate and Variable Air Volume (VAV) Systems

In basic VAV systems the leaving supply air temperature is generally kept constant and the flow rate of air is reduced as the sensible load reduces. As for the constant air volume system, the coolant flow is also throttled and again this tends to decrease the slope of the coil condition curve for a given air entering condition since the coolant-side heat transfer coefficient is reduced. However this effect is partially offset by the reduction in the air flow rate, which reduces the air side heat transfer coefficient and, as discussed above and illustrated in FIG. 7*a*, also reduces the interface temperature of the air and the interface temperature over a larger proportion of the coil, resulting in an improved driving force for dehumidification. The combined result of these two opposing influences is that throttling of the coolant flow rate at part load causes the slope of the coil condition curve for a given air entering condition in a VAV system to be steeper than that in a CAV system but less steep than that achieved by the present invention. Reducing the coolant temperature rise by careful choice of coolant flow and flow circuiting, and/or lowering the coolant supply temperature, are additional means by which the steepness of the coil condition curve may be controlled.

(ii) Dehumidifier Size

The mismatch which exists between the size of the dehumidifier coil selected for full load design conditions and the actual load to be offset at part load conditions constitutes one major difficulty which is overcome by this invention.

It is not uncommon for an air conditioning system to be required to satisfy a part load sensible condition which is 40% or 30% of the full design sensible load. Existing practice appears not to appreciate the consequences which result when a dehumidifier, which is properly sized for a peak design load, is required to perform at part load conditions. It is rare for part load performance to be specified by consulting engineers. At low load conditions the coolant flow rate through a given coil, which for such conditions is disproportionately large in relation to the magnitude of the load, drops to a trickle. Inevitably, the heat transfer coefficient inside the tubes reduces to a small value and the coil surface temperature increases.

The reduction in the coolant side heat transfer coefficient occurs both with liquid flow coolants such as chilled water or ethylene glycol, and with liquid and vapour flow coolants such as refrigerant R12 or R22. In the latter case a number of flow patterns occur depending on the mass fraction of liquid, the fluid properties of each phase and the flow rate. A good understanding of the effect of low mass velocities of refrigerants on the heat transfer coefficient is presented in FIG. 9 ASHRAE Handbook 1985, Fundamentals, published by the American Society of Heating Refrigerating and Air-Conditioning Engineers Inc., Atlanta, Georgia, U.S.A., on p 4.7. It is there clearly demonstrated that a drop in the mass flow rate of the refrigerant to 40% of the indicated peak mass flow rate is associated with a drop of up to 34% in the heat transfer coefficient.

For a large proportion of the coil the surface temperature may become greater than the dew point temperature of the air to be treated, with a consequent loss of dehumidification. For this second reason the slope of the coil condition curve of a conventional air conditioning system at part loads becomes shallow just when it is required to become steep, despite the steepening effect of a drop in face velocity of air passing through the coil.

(iii) Secondary to Primary Surface Area Ratio, (Fin Density).

The lower the temperature of the wetted outside surfaces of the coil the greater will be the condensation of water vapour on those surfaces. Fins, or secondary surfaces, have a higher surface temperature than do the tubes, or primary surfaces. As fin density increases, the average fin temperature also increases. By having a large proportion of primary surface area, the dehumidification per unit of surface area will be large; but if taken too far this consideration would lead to coils with many rows of depth which do not make efficient use of the material of which they are made. Thus there is an optimum ratio of secondary to primary surface which gives the best use of material in achieving the required degree of dehumidification for a given application. Seeking to reduce coil depth by using very high fin density is poor practice if dehumidification is required. While it may result in a small reduction in size and therefore first cost of the dehumidifier, there is firm evidence that it inhibits dehumidification and hence compromises part load performance. The slope of the coil condition curve will decrease, performance will be impaired and fan power requirements will be increased because of the higher resistance offered to the air flow by the high fin density.

(iv) Performance

The variable air volume (VAV) system is frequently employed in air conditioning design, especially when energy consumption and space requirements are considered. However the system has often been widely criticized by building occupants because under part load conditions performance does not satisfy expectations. One article by Tamblyn in the September 1983 ASHRAE Journal, with reference to new VAV systems, lists complaints of '... stale air and lack of air motion ...' and reports that 'Owners are fighting back in energy consuming ways by raising outside air ratios, operating fans longer and setting minimum airflows which demand the use of the same reheat that was formerly eliminated'.

Reference can also be made to the August 1987 ASHRAE Journal, page 22, wherein the problems of VAV systems are discussed in detail by a distinguished forum. The problems are listed as uneven temperatures, lack of temperature and humidity controls, lack of air motion, lack of fresh air, and excessive energy consumption. Even reheating is recommended in that article as a realistic solution to the problems. Further, it has been suggested therein that only interior zones should be serviced by VAV systems.

A typical VAV system which is particularly advantageous in conserving both space and energy is that in a high rise office block which employs air handling units on each floor. The need for large shaft spaces and long duct runs is eliminated since each air handling unit is located on the floor it serves. It is conventional to utilize the ceiling space as a large return air plenum. If such a building is located in a city, such as Melbourne, Australia, or Dallas, Texas, the system will be designed to operate with a high outside air dry bulb temperature, say 95° F. (35° C.) and a low humidity during summer peak design conditions. During part load days and marginal weather conditions when the ambient dry bulb temperature is lower, there are numerous periods during which the humidity ratio is considerably above the summer peak conditions. A typical minimum fresh air intake is the equivalent of 15% of the total peak design airflow rate. Since the minimum fresh air intake for meeting ventilation requirements is a fixed quantity, at 60% part load the requirement for outside air is (15/0.6)%, i.e. 25%, and at 30% part load the requirement is for 50% outside air. Thus the dehumidifier is burdened on humid part load days not only with an outside air humidity ratio condition which is higher than that at peak loads, but also with a higher percentage of outside air. Frequently this demand is beyond the capability of the conventional VAV system which largely accounts for the many complaints that the atmosphere is "humid" or "stuffy".

RELATED ART

As far as is known to the applicants no prior art exists wherein under part load conditions the coil condition curve will become sufficiently steep to satisfy closely the sensible and latent heat loads in the required ratio while closely maintaining a given condition in the room.

Reference however may be made to the ASHRAE Transactions 1982 (Shaw) and the corresponding U.S. Pat. No. 4319461. That reference indicated that face velocity of moist air influences part load performance As the Reynolds number and face velocity are reduced, the slope of the coil condition curve becomes steeper and the curvature of the coil condition curve reduces towards that of a straight line.

This matter was further dealt with by Shaw in Proceedings of the Seventh International Heat Transfer Conference, Munich F.D.R., V.6, Hemisphere Publishing Corp., Washington D.C. pp 427–432, 1982. Further reference may be made to an article by Shaw aforesaid, and Professor R.E. Luxton, 1985, "Latest findings on airstream velocity effects in heat and mass transfer through dehumidifier coils," (Proceedings of Third Australasian Conference on Heat and Mass Transfer, at Melbourne University, published by E.A. Books, St. Leonards, N.S.W. (May 1985, pp 185–192; Shaw, A., Luxton, R.E., "High quality tropical air conditioning with Low Energy Consumption," Proceedings of Far East Conference on Air Conditioning in hot climates, ASHRAE, Singapore, pp 155–161 (Sept. 3–7, 1987); Shaw, A., Luxton, R.E., "A comprehensive method of improving part-load air conditioning performance," ASHRAE Transactions, Volume 94 pt 1 (1988); Luxton, R.E., Brown, M.R., and Shaw, A., "An assessment of achievable air conditioning energy cost savings," Fourth ASEAN Energy Conference — Energy Technology, Singapore (5—7 November, 1987).

The closest prior art known to the Applicants claimed in U.S. Pat. Nos. 2,614,394 (McGrath) and 4,259,847 (Pearse, Jr.) These are discussed hereunder: U.S. Pat. No. 2,614,394 (McGrath) describes a plurality of coils (15 and 16) through Which coolant is pumped and within which a reduced load is sensed by thermostat T which controls valve 17. This is actuated to close off coil 16, whereupon coil 15 remain the sole evaporator in the system.

However, when coil 15 alone is operative, there is less heat transfer surface and therefore less heat is transferred to the refrigerant. There is no indication in the specification of any circumstances which would result in coil 15 alone, by intention or by chance, having an increased coolant velocity, giving a higher coolant side heat transfer coefficient, a sensible cooling capacity equivalent to that previously provided by coils 15 and 16 together and a lower sensible heat ratio as achieved by the present invention. The McGrath invention is concerned With capacity control. There is no provision for effecting an increased coolant side heat transfer coefficient. On changeover the thermostatic expansion (Tx) valve throttles the refrigerant flow with drop in load until the refrigerant approaches a pressure and temperature at which frosting of the moist airstream could effectively insulate the evaporator to the point where liquid refrigerant may reach and seize the compressor It is then that the McGrath invention introduces hot gas via a valve into the evaporator system. Though this action prevents frosting and seizing of the compressor it increases the energy required to run the compressor such that when the actual refrigeration load is small there is no appreciable change in horsepower from that at peak load. This is confirmed in the Air Conditioning and Refrigeration Institute text entitled "Refrigeration and Airconditioning", Prentice Hall, Englewood Cliffs, New Jersey, Second Edition, 1987, p 443.

In the present invention the dehumidifier is not directed to capacity control, nor to avoidance of frosting. An object of the present invention is to provide means and method of achieving the dehumidifier performance necessary to fulfill the basic purposes of air conditioning. As indicated above, these are to:

offset the sensible heat load and latent heat load, and offset these loads simultaneously in the correct ratio;

satisfy the ventilation load, the effect of reheat on the return air and the need to maintain sufficient air motion;

and achieve these purposes without incurring unnecessary energy costs.

Pearse, Jr. U.S. Pat. No. 4,259,847, Apr. 7, 1981, discloses a stepped capacity constant air volume air conditioning system. As explained by the inventor in Column 2 lines 17 to 29, "The invention contemplates the operation of a constant volume air conditioning system under a reduced but steady air volume mode which is simultaneously accompanied by a reduced flow of tempering heat exchange fluid to the air [temperating ](sic) heat exchanger. In most embodiments the flow of heat exchange fluid is reduced to that which is commensurate with the reduced air volume which causes the air [temperating ](sic) heat exchanger to affect the sensible and latent heat load in generally similar proportions as it did when the system was operating at the higher capacity level. The change in tempering heat exchange fluid flow is accomplished by a reduction in compressor capacity. "

Further, Pearse, Jr frequently stresses, for example Column 5 lines 49–51, "The ratio between sensible and latent cooling remains substantially the same whether the system is operated at high or low capacity."

The intention as stated in the above extracts and claimed in the Claims is to maintain effectively the same ratio of sensible to latent cooling capacity.

A further objective is, ". . . to provide an air conditioning system which is operated at low blower capacity, means to prevent frosting of the evaporator heat exchanger." (Col. 1 lines 55–58).

In essence, the invention claims means of integrating and controlling the operation of two or more discrete constant volume direct expansion air conditioning systems within the one unit to give stepped capacity control to reduce the possibility of low-load frosting and, by intertwining the tubes of the evaporator coils of each unit, utilize the whole face area of the coil at each step in capacity. This last feature is claimed to allow stepped reductions in air flow face velocity to accompany the stepped reductions in refrigeration capacity to maintain an almost constant sensible heat ratio, i.e. ratio of sensible to total (sensible plus latent) cooling capacities, at all capacity steps.

It is an object of this invention to provide a system designed with better means by which to offset the loads within the conditioned space, by providing automatic control of the ratio of sensible to latent cooling, determined by the ratio of sensible heat and latent heat transferred to and generated within the air conditioned space.

More specifically, just as there is a 'driving force' for sensible heat transfer, namely the difference in temperature of the air entering the dehumidifier coil and the average coolant temperature, so too is there a 'driving force' for latent heat transfer (condensation of moisture from the air), namely the difference between the dew point temperature of the air entering the dehumidifier and the surface (interface) temperature of the coil, and it is an object of this invention to provide means for controlling those driving forces.

Assuming constant outside air conditions and constant air volume, if the coolant temperature and flow are fixed and the (sensible) heat transfer coefficients are fixed, an increase in the sensible heat load within the room will cause the temperature of the air in the room to rise. If no action is taken, the room temperature will rise to a value at which sufficient 'driving force' exists between the air and the coolant in the coil to allow the new, higher, sensible heat load to be transferred to the coolant. In practice action is taken by the control system to increase the coolant flow rate and so decrease the interface temperature to establish the required 'driving force'.

The effect of an increase in latent load in the room is similar. In the absence of any control action the dew point of the air in the room will rise (that is the moisture content Will rise) until a sufficient driving force for moisture transfer is established at the coil to offset the increased latent load. In practice it is rare for dew point or humidity sensors to be employed in an air conditioning control system, thus the rise in moisture content of the air in the room is inevitable. The process is comparable, with appropriate variations, for VAV systems or where outside air conditions change. Reference may be made to the article by the inventors "An overview of low face velocity air conditioning", Australian Refrigeration, Air Conditioning and Heating, July, 1988, Vol 42 No 7, in which the phenomenon is referred to as "the moisture staircase".

A VAV system operated according to the U.S. Pat. No. 4,259,847 can be shown to achieve the result indicated by the dashed lines in FIG. 1 hereunder. The sensible heat ratio for the room, indicated by the slope of the dashed line DF, and that for a sYstem operated according to the present invention, indicated by the slope of the solid line CE, are the same; the sensible heat ratio being a variable input which is imposed on the air conditioning systems by the room and is not set by the designer. However it is the system Which determines the locations of the load ratio lines CE and DF on the psychrometric chart. The system also determines the point to which the room moisture content will move up "a moisture staircase". When the above discussion is considered in the context of the potential for sensible heat ratio to decrease as sensible load decreases in a real building, it is apparent that, even if Pearse, Jr. could achieve his claims, a system according to his invention would fail to maintain comfort conditions.

The present invention is applicable to any type of coolant such as chilled water, glycol or a refrigerant. The Pearse, Jr. patent relates only to refrigerant (DX) systems.

Where Pearse, Jr. seeks to maintain the same sensible heat ratio at all loads, the present invention by contrast seeks to decrease sensible heat ratio as sensible heat load reduces in response to reduction in room sensible heat ratio which typically occurs in buildings as the sensible heat load decreases.

Thus where Pearse, Jr. reduces the refrigeration capacity when a portion of the evaporator coil is deactivated, the present invention increases the refrigeration capacity relative to that immediately before the change-over. By this means the same sensible cooling capacity can be maintained after change- over as existed before change-over and the latent cooling capacity can be increased, giving the required reduction in sensible heat ratio. In the direct expansion embodiments of the present invention this particular feature usually eliminates the problems of low capacity frosting of the evaporator and liquid refrigerant reaching the compressor.

That the basic concept of the present invention is in direct contrast to the prior art concept disclosed by Pearse, Jr., in the above quotations is clearly demonstrated by FIGS. *7a* and *7b* herein of which a full description is provided below on page 24, line 12 to page 25 line 14.

BRIEF SUMMARY OF THE INVENTION

In this invention an air conditioner has a dehumidifier with a plurality of coil portions, and a temperature sensor selectively controls coolant flow through those coil portions in such a way that, upon reduction ±rom full load to part load, coolant flow is reduced through some of the coil portions but increased through the remaining coil portions. Increase of coolant flow results in increased heat transfer coefficient on the coolant side and therefore more dehumidification by the operative coil portions. Thus the ratio of latent to sensible cooling increases for part load conditions, and can be controlled to match comfort zone requirements.

The invention can thus achieve an air conditioning system which provides dehumidifier performance over the full cooling cycle range which will (a) offset the sensible heat load, (b) offset the latent heat load, (c) offset these loads simultaneously in their correct ratio, (d) satisfy the ventilation needs, the effect of reheat on the return air and the need to maintain sufficient air motion, and (e) achieve these purposes without incurring unnecessary energy costs.

There are three major factors in achieving the air-conditioning performance obtained through the system and method of this invention. These factors involve the interaction of (i) the coolant velocity (ii) the face velocity, and (iii) the dehumidifier size.

There are numerous means by which these interactions may proceed. Effective dehumidifier size is made flexible by dividing the dehumidifier into portions and grouping portions as stages. Variation of dehumidifier size may, for example, proceed in finite stages as is disclosed hereunder It may also proceed by a gradual deactivation of portions through decrease of coolant velocity on a drop in air conditioning load whilst simultaneously other portions are further activated through an increase of coolant velocity, as is also disclosed hereunder.

Variation in coolant flow may proceed based on the dehumidifier having a single supply and a single return of the coolant and, though several portions are present, a single modulating valve may control the coolant velooity through all active portions of the dehumidifier. This coolant velocity may be the same for all portions of the total range when each portion has the same circuiting, or it may vary. [FIG. 3 hereunder is an example of such a system.] Alternatively the coolant flow may have several feeds in series or in parallel through the different stages and may have several modulating valves. [Such an embodiment is indicated in FIGS. 4*a*, 4*b* and 4*c* hereunder. ] At any particular instant different coolant flow rates and velocities may exist as is indicated in FIG. 5 hereunder.

Variation in face velocity is also an important part of the interaction. It obviously will occur with VAV systems. It also will occur in the design stage of CAV systems in the sense that the face velocity employed at peak conditions will be selected to be compatible with the total system performance at all load stages. This need is clearly illustrated in FIGS. 7*a* and 7*b* hereunder and in the development of the significance of Low Face Velocity-High Coolant Velocity (LFV-HCV) disclosed in this specification. In a tropical climate it is very likely that the choice of the face velocity for peak operating conditions of a CAV system for this invention may be 1 m/s or less, a most unconventional face velocity.

Numerous configurations may be devised to derive benefit from the interactions of three major factors enumerated above, namely coolant velocity, face velocity and dehumidifier size, on which the present invention is based. Different configurations will be found to be appropriate for different climatic regions and different building functions. Disclosures of example configurations and embodiments in this specification may be regarded as an indication of the flexibility which the invention makes available to the designer of air conditioning systems.

In the present invention changeover to a smaller coil portion takes place at some part load condition when the larger coil portion has reached the minimum acceptable part load performance for its range through throttling of the coolant flow. Further throttling of the coolant flow may satisfactorily offset sensible heat load as it continues to decrease, but without this invention would fail fail to offset the latent heat sufficiently to achieve an acceptable moisture content in the conditioned space. As indicated previously conventional solutions such as overcooling and reheating the airstream are wasteful of energy, and other solutions such as the use of air bypass systems are inadequate for all but a very narrow range of operations. However in the present invention the larger coil portion having a low coolant velocity is exchanged with a smaller coil portion having a higher coolant velocity. At the point of changeover the coil portions selected are such that the smaller coil portion offsets the same sensible heat load as the larger due to the higher coolant flow rate, but also offsets the latent heat load due to the higher coolant velocity producing a higher coolant side heat transfer coefficient and thus a lower coil surface temperature at the interface with the airstream. This is illustrated hereunder in FIGS. 7*a* and 7*b*, and it is thereby that a higher ratio of dehumidification to sensible cooling occurs. In this manner part load conditions can be adequately satisfied.

It is only in rare cases, e.g. where load variation is not large and outside air is separately treated, that it may be possible, by choice of a very high coolant flow rate and a low face velocity at peak conditions, to span the whole of the load range without change-over. In some oases only one change-over may be necessary. In many cases two change-overs will suffice where human comfort is the prime requirement. The need for more than three change-overs is unlikely. However, a three changeover embodiment of the type of arrangement described above is shown schematically hereunder as an example in FIG. 3*a*.

The difficulties associated with "humid" or "stuffy" conditions within an air conditioned space (when under part load), are resolved in this invention by maintaining a sufficiently high level of outside air to ensure adequate ventilation and air movement, and providing the coil condition curve characteristics which offset the room sensible and latent heat loads simultaneously in their correct ratio throughout the entire range of operating loads.

The present invention focuses attention on the need for improved dehumidifier performance if well engineered, low running cost air conditioning systems of minimum complexity are to be achieved. The approach draws on the natural laws of thermodynamics and fluid mechanics. Proper safeguards are built into the design process to ensure stable operation and smooth changeover between dehumidifier size stages without the need to rely on time delay switches to avoid hunting between stages. Control is very simple as only sensible temperature sensors are needed for a CAV system and sensible temperature sensors and volume flow sensors, such as supply duct pressure, for a VAV system, in addition to the conventional local zone VAV controls. All other control functions can be software mounted.

In embodiments of low face velocity-high coolant velocity (LFV-HCV) technology which employ direct expansion dehumidifier (expansion) coils it is recognized that as the refrigerant flows through the coil the temperature drops with the pressure, and while this can assist dehumidification by providing a greater driving force for mass transfer, if the system is not properly engineered and safeguarded, frosting and seizing of the compressor can result.

The foregoing description is for a decreasing load. The process proceeds in the reverse manner when the load increases To avoid hunting of the control system between stages on either side of a change-over point an overlap is arranged between stages.

With an embodiment of the invention employing several coolant feeds to the dehumidifier portions the flow of coolant through the coil is controlled in such a way that a high coolant flow velooity is present in a sufficient portion of the coil to ensure that there is sufficient dehumidification capacity at all load conditions. The preferred strategy is to increase the coolant flow rate through a portion of the coolant circuit through the dehumidifier as coolant flow reduces through another portion. FIGS. 4 and 5 represent such a system. This aspect of the invention is discussed further below and is represented in claim 10.

Each portion of the dehumidifier may be independent in its design and arrangement; that is, each portion may have a different circuiting, different fin density, different rows of depth, different geometry. Thus each coil can have different coolant temperature rises across different portions. Thus when chilled water or glycol is the coolant it is an advantage to have small coolant temperature rises through the active portions of the coil in order to increase dehumidification at fractional load conditions.

By these means it is possible to increase the slope of the coil condition curve, which in the limit of negligible face velocity approximates a straight line.

BRIEF SUMMARY OF THE DRAWINGS

An embodiment of the invention is described hereunder and is illustrated in the accompanying drawings in which:

FIG. 3*a–3d* illustrate diagrammatically four stages of cooling, FIG. 3*a* showing a typical coolant flow control for chilled water, FIG. 3*b* a coolant velocity chart corresponding to the four stages of FIG. 3*a*, and FIG. 3*c* a diagrammatic layout illustrating the first stage only but when the coolant is a refrigerant, and FIG. 3*d* is a graphical comparison of the FIGS. 3*a–c* embodiment with the prior art, with respect to an established "comfort zone".

FIG. 6*a* indicates the control means in block diagram form;

FIG. 6*b* indicates the control software and its operation;

FIGS. 7*a* and 7*b* illustrate heat transfer between fluids across an interface surface.

DESCRIPTION OF THE PREFERRED EMBODIMENTS

Figure 7A:
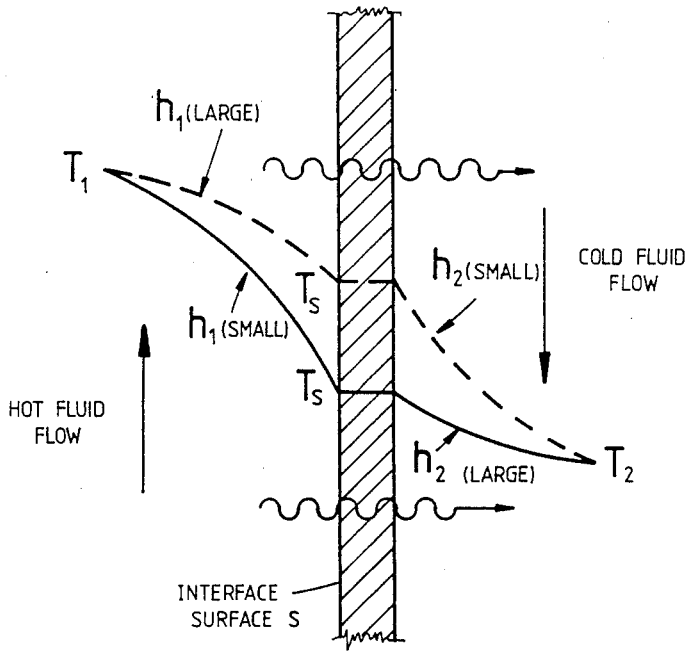
FIG. 7*a* shows schematically the improvement in cooling the interface achieved by this invention (full lines) over prior art, (dotted lines)

The theoretical basis of this invention can be ascertained from the known schematic diagram of FIG. 7*a*. The hot fluid (air) has a temperature which needs reducing beloW dew point to Ts if dehumidification is to be effected. The cooling is effected by flow of cold fluid (coolant) which is at temperature T2. If the heat transfer coefficient $h_1$ of the air is large, due to (inter alia) high air velocity, temperature Ts will be high, probably above dew point. If the heat coefficient $h_2$ of the coolant is small due to low velocity, temperature Ts will again be high. This is the usual condition in prior art installations at part load, and illustrated in broken lines in FIG. 7*a*.

If the reverse is true (full lines in FIG. 7*a*), Ts is low, below dew point. The result is illustrative of the part load condition achieved by this invention wherein there is a low air velooity and a consequential low heat transfer coefficient $h_1$, and a high coolant velocity and a high heat transfer coefficient $h_2$.

Figure 7B:
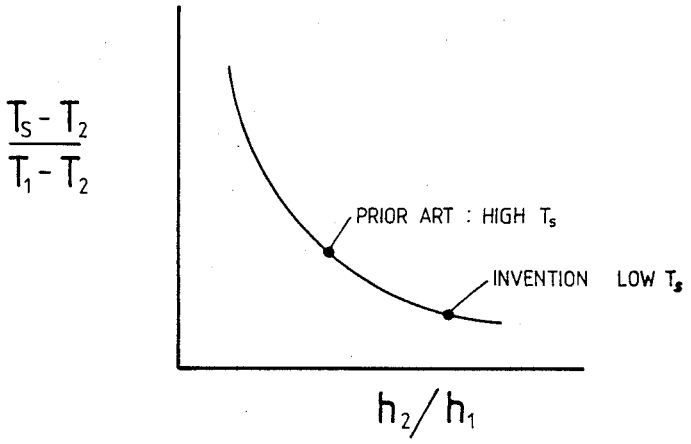
FIG. 7*b* shows improvement in the relationship of temperature at the interface surface, when the heat transfer coefficient of the coolant is high and of the air is low (for the same temperature difference)

FIG. 7*b* is a graphical representation of the temperature variation compared with heat transfer coefficient For sensible heat transfer $$\frac{Ts - T2}{T1 - T2} = \frac{1}{1 + h_2/h_1}$$

The invention seeks to achieve a small value of corresponding to a low (dehumidifying) surface $$\frac{Ts - T2}{T1 - T2}$$

temperature at the interface surface S , and therefore $h_2$ should be much greater than $h_1$ so the h2/h1 is large. Thus FIG. 7*b* shows graphically what FIG. 7*a* shows physically, that is, high coolant velocity and low air face velocity through a coil combine to lower interface temperature and thereby increase dehumidification. This is most important when part-load conditions exist.

It will be clear that there are many instances wherein valve restrictions are necessary as indicated in FIGS. 5*a*, 5*b*, 5*c* and 5*d* 5*b*, for example, wherein an oversized air conditioning plant is installed in anticipation of building additions. In many instances it is necessary to restrict partly the flow of coolant through the dehumidifier even under peak load conditions, and therefore often restrictions to coolant flow described hereunder must be regarded as relative restrictions. For example, in the dynamics of air conditioning requirements environmental considerations are foremost factors in determining dehumidifier selection. As an illustration, in a climate which is dry during peak air conditioning loads such as Melbourne, Victoria and Dallas, Texas, there is no need for maximum coolant flow during peak air conditioning periods and therefore coolant flow may be partially restricted whereas there is good reason for the least restriction to coolant flow during part load but humid conditions. FIGS. 5*a*, 5*b*, 5*c* and 5*d* graphically indicate this effect.

Figure 3A:
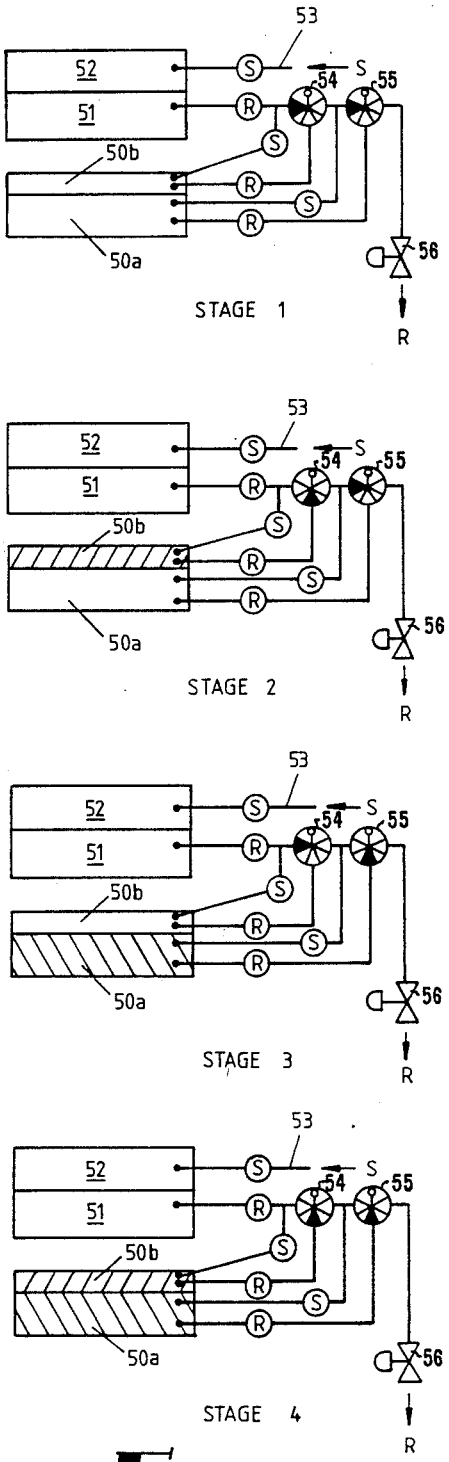
Figure 3B:
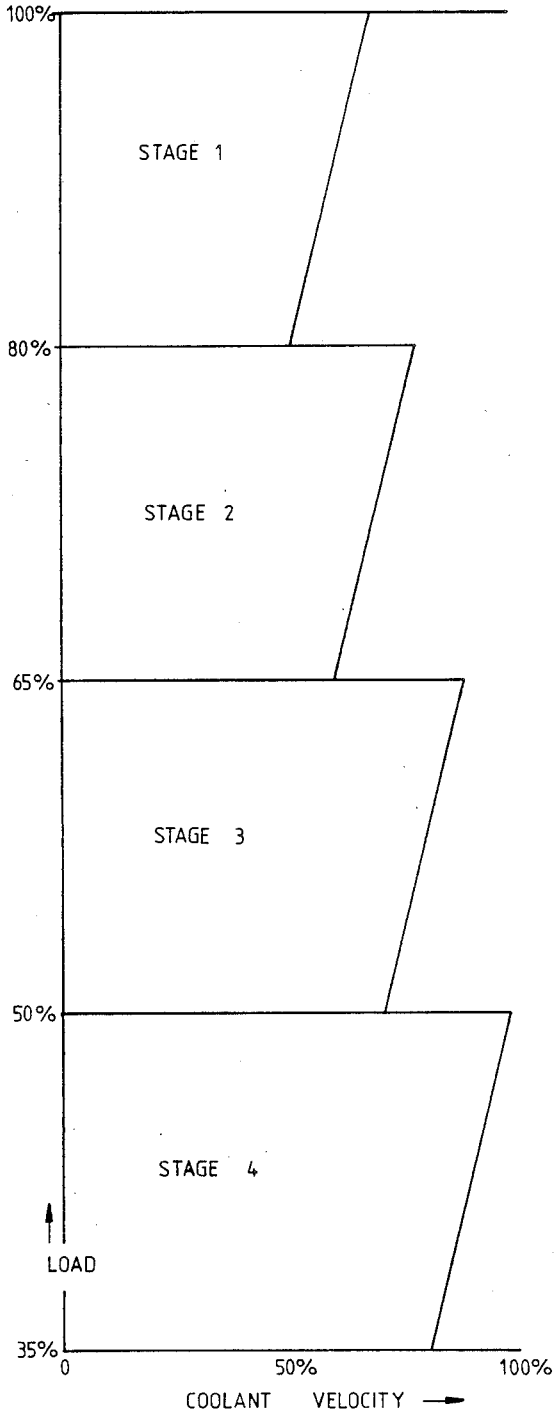
Figure 1:
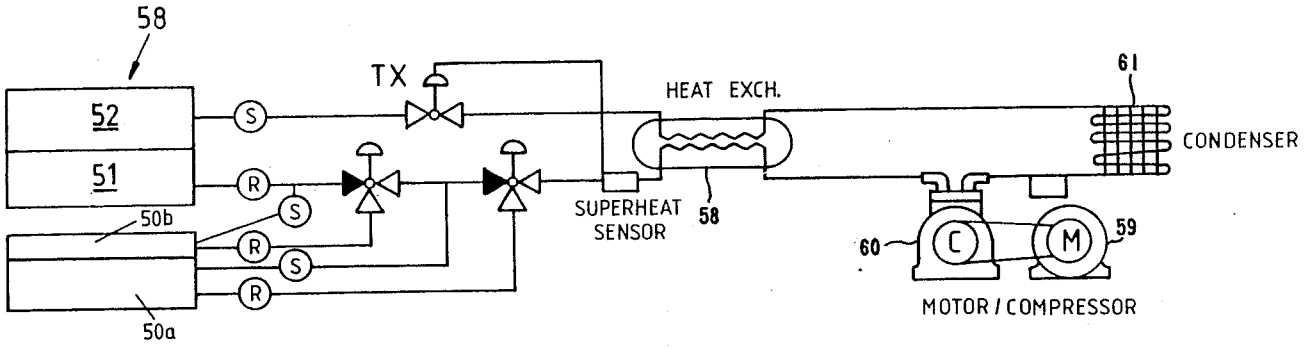

Reference is now made to FIGS. 3*a* and 3*b* which simplistically illustrates four alternative configurations of coil portions for four ranges of load, this is 100% to 80%; 80% to 65%; 65% to 50%; and 50% to 35%.

A heat exchange coil complex is shown in FIG. 3*a* and comprises a two portion upstream coil 50*a* and 50*b* in a first row, a second portion 51 and a third portion 52. The complex thereby comprises four coil portions which are connected to a chilled water supply line 53, and interconnected with each other with two three-portion valves 54 and 55, in four different configurations wherein the coil portions are differently connected. The coil complex could of course merely consist of four entirely separate coils each exclusively operable, but such an arrangement is mechanically inconvenient, and the mechanical equivalent therein described is much preferred. The designations S and R indicate supply and return lines to the coil portions, the "open" triangular sectors represent open valve ports and the "blooked in" triangular sectors represent closed valve ports. Cross-hatching of the portions indicates the inoperative coil portions, 56 is a modulating valve which performs the function of throttling between transition points.

The following is a simplified summary of the operative coil portions:

| STAGE | LOAD | COIL PORTION 50a | COIL PORTION 50b | COIL PORTION 51 | COIL PORTION 52 |
|---|---|---|---|---|---|
| 1 | 100%-80% | Operative | Operative | Operative | Operative |
| 2 | 80%-65% | Operative | Inoperative | Operative | Operative |
| 3 | 65%-50% | Inoperative | Operative | Operative | Operative |
| 4 | 50%-35% | Inoperative | Inoperative | Operative | Operative |

FIG. 3*b* compares coolant velooity with load, and illustrates increase in coolant flow velocity as the load reduces from peak load conditions towards minimum load conditions. (The flow is of course then through smaller portions of the coil complex.)

FIG. 3*c* illustrates an alternative configuration wherein the heat exchanger is an evaporator 58 of a compressor type refrigeration installation, having a motor 59 driving a compressor 60 to compress a refrigerant which is condensed in condensor 61 before returning through the operative coil portions to compressor 60. The compressor 60 is a variable speed compressor, and variations in coolant flow are at least partly achieved by varying the compressor speed.

Figure 3D:
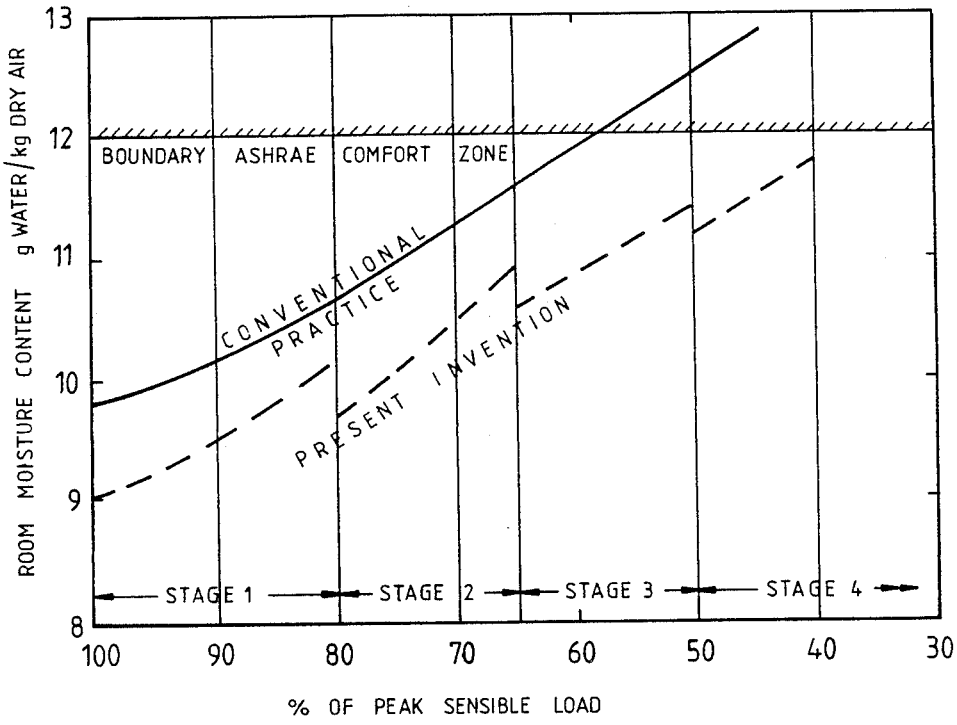

In FIG. 3*d*, a comparison between a FIG. 3 installation and a similar size average conventional installation under identical conditions is illustrated graphically, and shows clearly how an installation according to this invention can retain a conditioned space within a "comfort zone" down to less than 40% of peak load. Thus this invention offers choice in both size and variation in performance characteristics which makes possible the best fit over the full air conditioning load range. This too influences restrictions of the coolant flow.

Thus it can be seen that there are numerous special considerations, as described above, which may support or oppose the general load characteristics which prevail during reduced load performance. It is these special considerations which are related to the use of the term "relative" restrictions.

The total coil complex in this invention is divided into coil portions to allow reduction of the effective size of the total coil as air conditioning loads reduce below the peak loads in such manner that during these part loads the coolant velocity through the remaining active portions of the coil complex may be increased to maintain or augment the dehumidification capacity of the coil system. It is in this manner that a coil condition curve during part load is obtained which satisfies the general load characteristic and the increasing ratio of latent heat to sensible heat load characteristic which develops during part loads. A steeper slope to the coil condition curve results and the curvature of this curve reduces towards that of a straight line with reducing face velooity and with increasing coolant velocity and reducing coolant temperature rise. In this invention the range of the active size of the coil complex is matched to the operating range of the coil at all conditions of load from peak to minimum. The conventional method is very different since as the sensible heat load reduces no matter what performance is desired, the coolant velocity reduces. When compared with peak coolant conditions according to this invention, as indicated in the example illustrated in FIG. 5, at 40% of peak air conditioning load, there is about 70% of the coolant flow through the valves; at 60% of peak air conditioning load, there is maximum coolant flow through the valves. Clearly in this invention the capacity reduction is not necessarily proportional to the valve restriction of the coolant flow. The ideal aim in this invention is to reduce the active size of the dehumidifier as the air conditioning load reduces, increase the coolant velocity, and decrease the coolant temperature rise where possible in order to offset the sensible and latent heat loads in the same proportion in which they occur during the full range of loads encountered from peak to minimum.

Where a constant volume system is employed face velocity is not reduced at part load. Measures which can be adopted to improve dehumidification in these circumstances include the use of very low face velocity, designing for the maximum practicable coolant velocity at peak design load, and employment of a low fin density and low coolant temperature.

Figure 1:
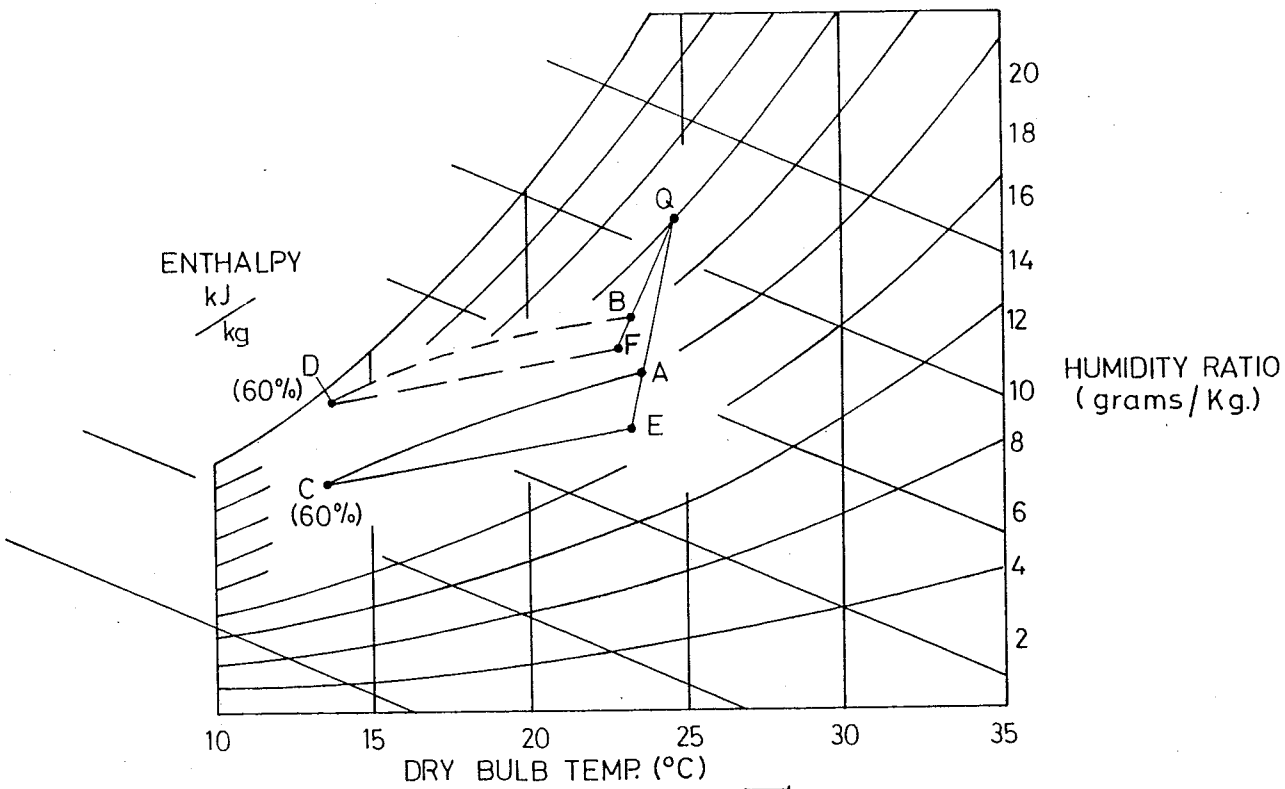
FIG. 1 is a simplified psychrometric chart illustrating the coil condition curves and the load ratio lines for variable air volume equipment used under conventional conditions (broken lines) and in accordance with this invention (unbroken lines)
Figure 2:
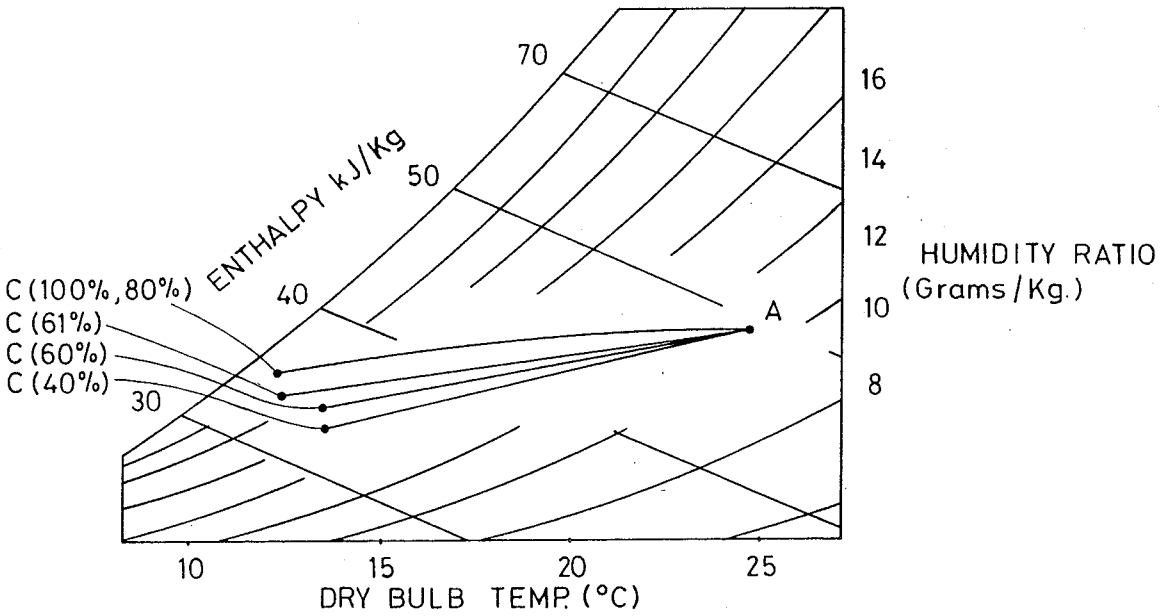
FIG. 2 illustrates the coil condition curves when the invention is used in similar sized equipment, and as described hereunder, under different percentages of load (100% and 80%, 61%; 60% and 40%)

FIG. 1 shows a comparison between VAV conventional systems (broken lines) and VAV systems according to this invention (full lines) at the same part load conditions. FIG. 2 shows increasing dehumidification with decreasing loads for a VAV system according to this invention.

Figures 4A, 4B, 4C:
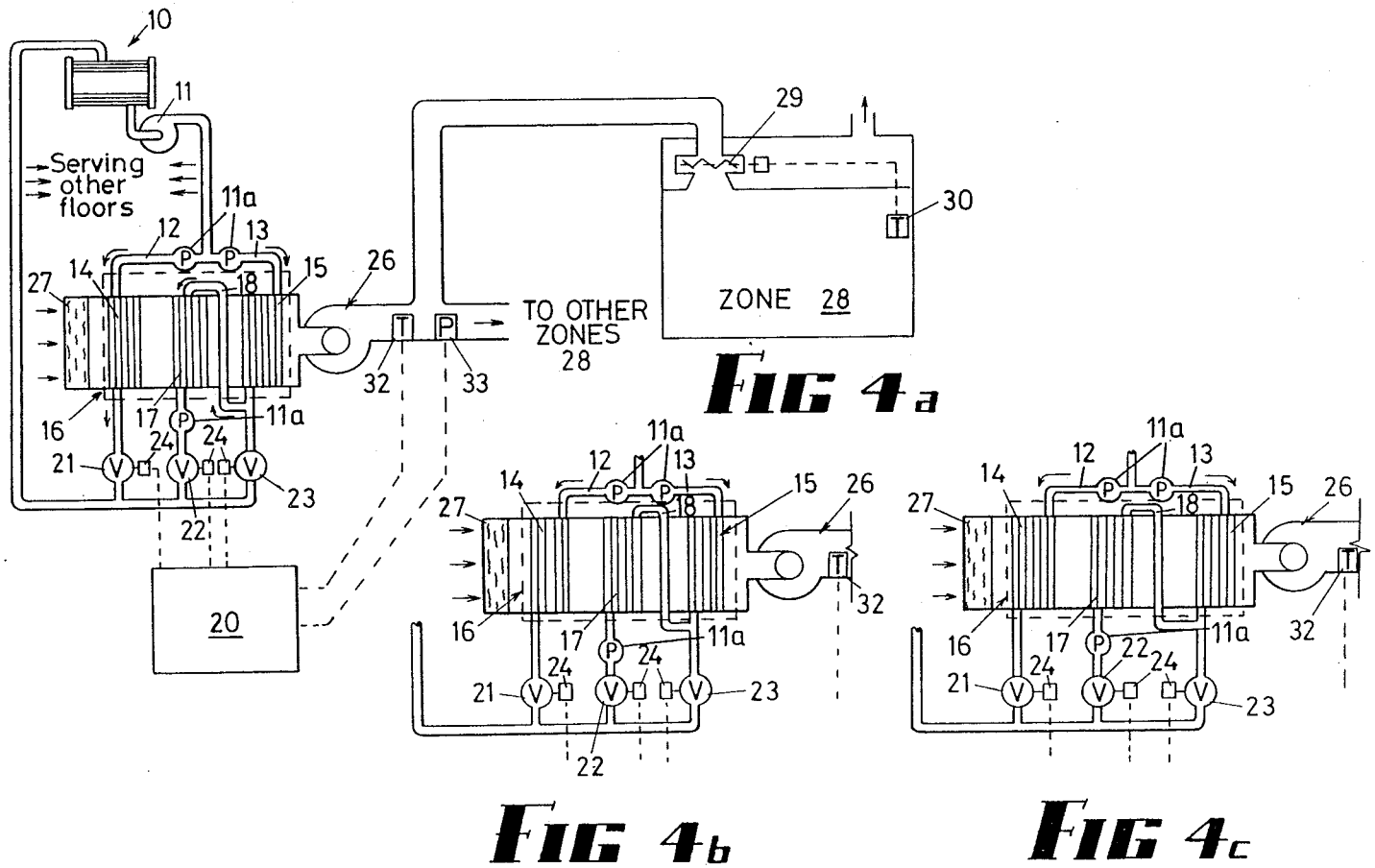
FIG. 4*a* illustrates the equipment by which the graphical results of FIGS. 1 and 2 may be achieved, indicating the entire installation under full load.
FIG. 4*b* illustrates the equipment as arranged under part load (60%)
FIG. 4*c* illustrates the equipment under part load (40%)

Reference is now made to FIGS. 4*a*, 4*b* and 4*c*.

In FIG. 4*a*, a heat exchanger (chiller) 10 has one circuit cooled by a refrigerant from a refrigeration plant (not illustrated) and its other circuit contains chilled water or some other coolant. The chilled water is pumped by the water pump 11 into two conduits 12 and 13 which feed chilled water to the first coil portion 14 and the third coil portion 15 of a dehumidifier 16 composed of coil portions 14, 15 and 17. The second coil portion 17 of dehumidifier 16 is fed by a bridging conduit 18 from the outlet side of the third coil portion 15. It must be emphasized that this embodiment is only exemplary of the invention and a wide range of configurations within the invention is available to a designer, including the use of a single throttling valve to service all portions and, in lieu of three coolant feeds to coil portions 14, 15 and 17, there is but a single feed. However, the FIGS. 4*a*, 4*b* and 4*c* illustrate a gradual transition from one configuration to the next.

There is provided an electronic control designated 20, (shown in computer chart detail in FIG. 6), this being a computer control for controlling three valves designated 21, 22 and 23, each valve being operated by a respective solenoid, drive motor or other means, all solenoids or drive members being designated 24.

The electronic control 20 also functions to control a fan 26 which draws air through a filter 27, through the dehumidifier 16, and discharges to the zones 28, one of which is illustrated in FIG. 4*a*. Each zone 28 contains a baffle or air damper 29 controlled by a thermostat 30 in accordance with usual construction. (Thermostat 30 can be replaced by an alternative sensor which also, or alternatively, senses humidity.)

Figure 5A:
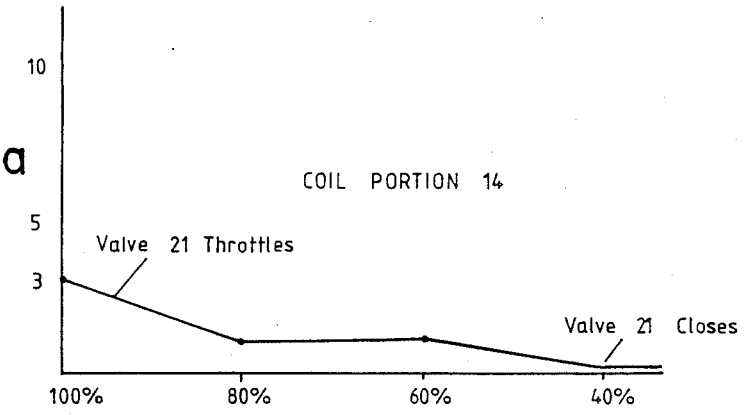
FIG. 5*a* illustrates graphically the control of the valves of FIGS. 4*a*, 4*b*, and 4*c* over the range of loads in one installation with respect to coil portion 14.
Figure 5B:
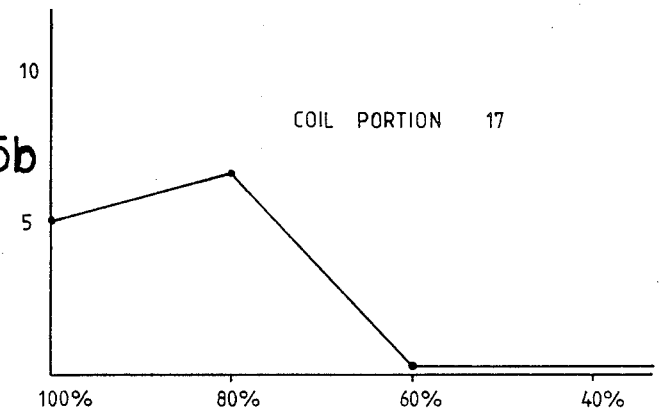
FIG. 5*b* illustrates the control of the valves of FIGS. 4*a*, 4*b* and 4*c* over a range of loads in one installation with respect to coil portion 17.
Figure 5C:
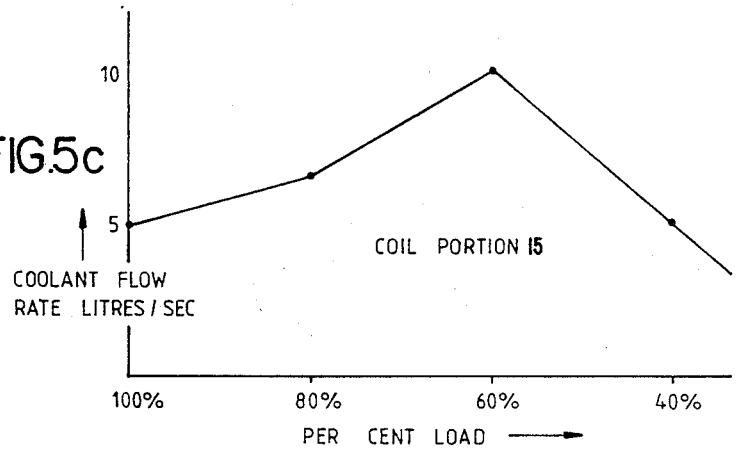
FIG. 5*c* illustrates the control of the valves of FIGS. 4*a*, 4*b* and 4*c* over a range of loads in the same installation over coil portion 15.

The manner in which the valves 21, 22 and 23 function is illustrated graphically in FIGS. 5*a*, 5*b* and 5*c* is as follows:

TRANSITION FULL LOAD TO PART LOAD 80%

Chilled water (or other coolant such as ethylene glycol, alcohol or antifreeze compound) is pumped by pump 11 (sometimes with auxiliary pumps ila which can assist in controlling coolant flow by speed variation or bypass throttling) through conduit 12 and the first coil portion 14, through open valve 21 and back to the heat exchanger 10. Valve 21 throttles towards an almost closed position as load reduces to 80%. Chilled water also flows through the conduit 13, the third coil portion 15, conduit 18, the second coil portion 17 and through the valve 22 which becomes increasingly open as valve 21 closes, and also to the chilled water return line to the heat exchanger 10. The valve portion 23 is closed. Flow through coil portion 14 reduces, and flow through coil portions 17 and 15 increase due to opening of valve 21. If pump 11 is a centrifugal pump, use is made of inherent characteristics that pressure increases upon coolant flow restriction in a coil portion, this providing an increase in flow rate through the remaining coil portions In the transition from full load to part load (60%) during the next phase, valve 21 remains nearly closed, valve 22 throttles to closure and valve 23 opens to fully open, and as this occurs flow through coil portion 14 remains small, there is a gradual reduction of coolant flow through the second coil portion 17, and an increase of flow through coil portion 15.

TRANSITION PART LOAD (80%) TO PART LOAD (60%)

The switching of portions of the dehumidifier is achieved by activation of the two 3-port, 3-way on-off valves whilst the single modulating valve regulates the overall flow of coolant, which in this example is chilled water, glycol, or similar secondary heat transfer fluid according to the flow rate schedule shown in FIG. 3*b*. The system is also applicable to direct expansion (evaporator) coils as indicated in the schematic diagram of FIG. 3*c*; the configuration equivalent to Stage 1 of FIG. 3*a* only is shown and coolant flow control if effected primarily by the variable displacement compressor.

A valve change-over occurs, and, as shown in FIG. 4, under control of electronic control 20, by their respective solenoids 24 to drive the valve members to occupy the conditions shown in FIG. 3*b*.

There is a small but constant coolant flow only through the first coil portion 14 through the partly open valve 21, full coolant flow through the second coil portion 17 which throttles to zero at 60% because of gradual closure of valve 22, and increasing coolant flow through the third coil portion 15 because of the progressive opening of valve 23. The 60% condition is shown on FIG. 2 as C 61%, C indicating the leaving condition of the air from the total dehumidifier complex 16 in accordance with the invention. This should be compared with C 100% (indicating 100% load), C 60% indicating the condition upon further valve change-over, and C 40% (indicating the condition described below at 40% load). However the condition shown for 60% load corresponds approximately to the full lines in FIG. 1 which is discussed below.

TRANSITION PART LOAD 60% TO 40%

Valve 21 throttles to closure whereupon there is no coolant flow through coil 14. Valve 22 remains closed and valve 23 remains open Valve 21 throttles towards a closed position, and valve 23 remains open, but throttles towards a minimum set coolant flow position. The coolant flow through coil portion 15 therefore is sloWly restricted, until at 40% part load it has reduced to a minimum set coolant flow rate.

PART LOAD AT 40%

The 40% part load condition is shown in FIG. 3*c* wherein valves 21 and 22 are both closed, while valve 23 is open, and therefore the coolant flow is solely through the third coil portion 15. If (as illustrated) the water pump 11 is a centrifugal pump, because of its inherent characteristics the flow through the third coil portion 15 will be greater than under full load conditions so that additional dehumidification will occur in coil portion 15 and this further assists in increasing the slope of the coil condition curve to the point marked C 60% as shown in FIG. 1. (In addition, in general, as shown in FIG. 4*a*, 4*b* and 4*c*, the coolant flow can be increased by the control system 20 to be preset to open any particular valve to any desired position.)

PART LOAD FROM 40% to 30%

Valves 21, 22 and 23 remain as shown in FIG. 3*c*, but valve 23 throttles further so as to reduce coolant flow through the third coil portions 15. There is no valve change-over.

MINIMUM PART LOAD AT 30%

In the minimum position, valve 23 is nevertheless partly open to allow a reduced coolant flow through the third coil portion 15.

Figure 5D:
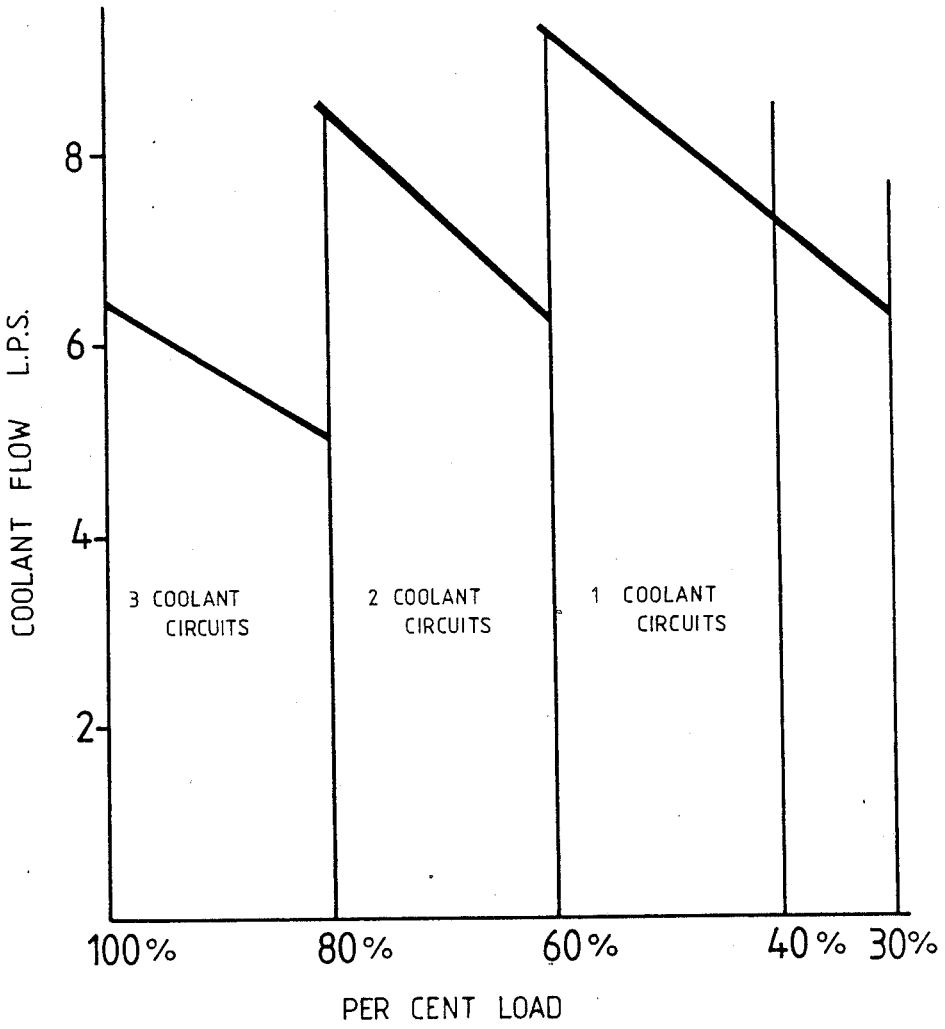
FIG. 5*d* is an alternative graphical representation of the valve control depicted in FIGS. 5*a*, 5*b* and 5*c*, but showing a simplified situation wherein coolant flow is directly proportional to coolant velocity.

All the above functions are shown in alternative graphic form in FIG. 5*d*, which illustrates increase in total coolant flow at the 80% and 60% value change-over stages.

Thus in this embodiment the coolant flow rate is at all operating conditions directly proportional to coolant velocity. FIG. 5*b* clearly indicates how high coolant velocity is obtained in this invention. The upwardly sloping extensions of the coolant flow lines represents "overlap" which avoids undesirable "hunting" at change-over points.

In the present invention the change-over to a smaller coil always takes place when conditions are the opposite from those addressed by McGrath. Here when a larger coil is required to maintain design conditions in the room over part of the load range, as the load decreases it will approach a point at which the coolant velocity required to satisfy the sensible load would be too small to maintain a low enough interface temperature to satisfy the latent load. Safely before this point is reached the larger coil can be truncated to form a small coil portion carrying increased coolant velocity such that it can satisfy both the sensible and the latent load and maintain the characteristic sensible heat ratio of the next lower load range.

As said above, one of the problems encountered with variable air volume systems (VAV) is that under very low load conditions the zone to be cooled and dehumidified becomes stuffy and unpleasant due to insufficient ventilation. The fan speed (or other air flow speed control) is controlled by the supply thermostat 32 and the air flow rate gauge 33, and in order to ensure a minimum volume air flow rate which will nevertheless provide adequate ventilation, the dry bulb temperature is raised by between 1° and 3°. This is achieved by means of the digital control device 20 as described hereunder. The percentage load can be determined by any one of the known procedures presently in use in air conditioning, and in this embodiment of the gauge 33, in a manner already in common use.

The gauge 33 may require modification where the enthalpy difference of the airstream across the dehumidifier varies considerably, since this is also a factor in fractional load.

The chart set forth in FIG. 6*b* shows the control software 20 and its operation. The control 20 can be any one of a number of readily available electronic controls for air conditioning purposes but in this embodiment comprises a controller and interface system respectively designated C500 and N500, and in combination DSC1000, available from Johnson Control Products Division, 1250 East Diehl Road, Naperville, Ill.

In FIG. 6*b*, INPUT 1 identifies design change-over ports and valve states, economy cycle conditions, termination states, interacting control systems, and other basic data. INPUT 2 identifies stage overlaps, return duct temperature gain (or loss), and conditioned space temperature gain.

The control logic memory stores the design characteristics of the air conditioner and the capacity to determine changeover between stages and modulation of coolant flow between stages.

Reference is now made to FIGS. 1 and 2 which graphically illustrate the advantages of the invention.

In FIG. 1, the dashed line B–D indicates the coil condition curve and the dashed line F–D indicates the load ratio line resulting at part load according to conventional control strategy. The slope of the load ratio line F–D is determined by the ratio of the latent to the sensible heat loads to be offset. Its position, however, is determined by the state of the air after it leaves the dehumidifier.

The designation Q indicates an example state of outside air under part load conditions. The line QF mixture of outside air with return air from the conditioned zone in the ratio of lengths FB/QB.

In the example of FIG. 1, a conventional system is compared with the system of this invention, wherein both are at the same part load conditions. It is important to note that, under part load conditions, the ratio of FB/QB will increase with further reduction in part load condition. For the same outside air condition, point Q, point B will rise to a still higher humidity ratio, further magnifying the problem. The system according to the invention will satisfactorily achieve the specified condition at low part load conditions.

The designation B indicates the point at which mixed air enters the dehumidifier according to conventional control, the designation D indicating the air condition as it leaves the dehumidifier and the designation F indicating the actual average zone condition achieved under conventional control conditions. This should be compared With the full lines where, according to the invention, the mixed air enters the dehumidifier at the point A, the leaving condition of the air from the dehumidifier according to the invention is at the point C, and the average zone condition of the air from the dehumidifier according to the invention is at the point C, and the average zone condition of the air by the invention is shown at point E, this being the average zone desired condition under part load. The upper full line is the coil condition curve in accordance with the invention and the lower full line the load ratio line in accordance with the invention.

Conventional systems, with the shallow coil condition curve characteristics illustrated in FIG. 1, do not achieve a leaving condition from the dehumidifier close to point E even if the air entering a conventional system is initially at point A.

To explain further, it is to be noted that conventional part load performance will result in a coil condition curve slope which is shallower than the slope of the full line A–C of FIG. 1. As a consequence, the leaving condition will be above that of point C. Given the same room load ratio line slope as indicated by the full line C–E, the return air at F from the treated space (dashed lines) will be at a higher humidity ratio than the desired point E. This return air, when mixing with the part load outside air at point Q will result in an entering condition to the dehumidifier which has a higher humidity ratio than at point A. Thus points A, C and E continue to ride up to an equilibrium point at which the slope of the coil condition curve B–D satisfies the required slope of the load ratio line D–F for the required quantity of outside air. This occurs when the slope of D–F equals the actual load ratio line slope.

The above description is for a very simple installation, and exemplifies the invention. However, in practice, it is somewhat unusual to encounter such a simple set of circumstances, and different coil control strategies will be required for different installations.

The mismatch which exists between the size of the dehumidifier coil selected for full load design conditions and the actual load to be offset at part load conditions is at the heart of the problem. Referring to FIG. 4, coil portions 14 and 17 are inactive when at this very low part load condition since valves 21 and 22 are closed. Thus the active coil portion 15 is enabled to have an increased coolant flow compatible with the face velocity and the high dehumidification requirement characteristic of part load conditions.

The above description relates to a decreasing load. The invention clearly extends to the reversal of conditions wherein the load increases from a fractional level up toward the design load condition.

SUMMARY

The main advantages of the invention are as follows:

(a) For both constant air volume and variable air volume systems, energy requirements are minimised and system performance optimized over the full range of sensible and latent heat loads.

(b) Noise is reduced under both part and full load conditions.

(c) The size of the coil which is active can be varied to match the actual load imposed and the active coil portions under part load conditions can have high coolant flow rates to offset increased ratio of latent heat to sensible heat, without overcooling. The water temperature rise over the coils may be less, also without overcooling of the air.

(d) The slope of the coil condition curve can be controlled to produce that load ratio line which is necessary to offset the sensible and latent heat loads in the proportion in which they occur while maintaining the required quantity of fresh outside air in the supply air to the conditioned space. In particular, the coil condition curve can be made steeper than for a conventional system, and can be made to approximate a straight line.

In general, the invention addresses the contradiction that arises with existing air conditioning systems due to the need to throttle coolant in order to reduce the refrigeration capacity on decrease of thermal loads. A reverse control of the sensible to latent heat load ratio occurs resulting in poor performance unless costly corrective methods are employed.

The invention divides the full environmental range served by the dehumidification into several smaller ranges (for example 100 to 80%, 80 to 60%, 60 to 40% and 40% to minimum per cent).

The higher range has more heat transfer surface than its adjacent lower range. It is obvious that if cycling will be avoided that on a change-over from say the 100 to 80% range to the 80 to 60% range that at 80% of the higher range the larger heat transfer surface having the same capacity. In this invention the coolant velooity through the smaller coil is increased so that it will have the same capaoity as the larger sized coil at its lower coolant velocity A larger coil at a lower coolant velocity is exchanged with a smaller coil at larger coolant velocity.

At each change-over the lower sized coil by virtue of the higher coolant velocity has a higher overall heat transfer coefficient across the coil. This results in:

(1) a lower outside surface temperature at the interface of the coil, between the moist air and the dehumidifier, (2) increase of the driving force for dehumidification more than the driving force for heat transfer from the air, (3) a lower sensible to latent cooling ratio compatible with the part load range, and (4) a consequential good performance at low energy without need for overcooling and reheating or poor performance high humidities, stale air and poor ventilation.

We claim:

1. An air conditioner comprising a dehumidifier having a plurality of coil portions, coolant supply means and coolant flow control means controlling coolant flow from the coolant supply means and through the coil portions selectively in one at least of a plurality of coolant circuits which embody said coil portions, so as to establish a plurality of stages of dehumidifier capacity, an air flow fan, means controlling air flow from the fan to be through one at least of the coil portions, at least one control sensor located to sense magnitude of load, and coupling means coupling said sensor to said flow control means in such a way that as load reduces from peak load conditions through part load stages towards minimum load conditions, coolant flow is restricted through one at least of the coil portions but coolant flow rate is increased in another of said coil portions to maintain the required sensible heat cooling capacity, in turn increasing the heat transfer coefficient on the coolant side of a heat exchange interface of said other coil portion thereby reducing the temperature of that interface and in turn increasing the ratio of latent heat cooling to sensible heat cooling of that interface.

2. An air conditioner according to claim 1 wherein said coolant is one of chilled water, ethylene glycol, alcohol and anti-freeze compound, and said coolant supply means comprises a pump which pumps the coolant through said coolant circuit at a velocity which increases through said relatively unrestricted remainder of the coil portions as the load reduces from one part-load stage to the next, and further comprising a plurality of auxiliary pumps within the coolant circuit selectively operable to increase said rate.

3. An air conditioner according to claim 1 wherein said coolant is a refrigerant and said refrigerant supply means comprises a compressor which pumps the refrigerant through an expansion device upstream of the coil portions and through a coolant circuit at a rate which increases coolant velocity through said relatively unrestricted remainder of the coil portions as the load reduces.

4. An air conditioner according to claim 1 wherein said coolant supply means comprise a plurality of auxiliary pumps which perform at least part of the function of flow control means by at least one of speed variation or bypass throttling to achieve appropriate coolant flow velocities in said coil portions.

5. An air conditioner having a dehumidifier comprising a plurality of coil portions, coolant supply means, conduits connecting the coil portions and the coolant supply means in a coolant circuit, flow control means in the coolant circuit operable to control coolant floW through at least some of the coil portions, an air flow fan, means coupling the air flow fan and the dehumidifier such that the fan, in operation, causes air flow through the coil portions, at least one control sensor downstream of the dehumidifier, coupling means linking the sensor to said flow control means in such a way that the full load range is divided into several sub-ranges each defining a part load stage, and under peak load conditions, coolant flow through the dehumidifier coil portions is relatively unrestricted by the flow control means, but, as the load reduces, coolant flow is relatively restricted by at least one of the flow control means through at least one of the coil portions of the dehumidifier, but coolant flow velocity increases through the remainder of the coil portions at each transition between part-load stages, thereby increasing dehumidification of the air by those portions and increasing the ratio of latent to sensible cooling.

6. An air conditioner according to claim 5 wherein said flow control means in the coolant circuit comprises at least one valve and wherein said sensor so controls the valve that restriction of coolant flow through at least one of said coil portions continues effectively to discontinuity of coolant flow as the sensible heat load continues to reduce.

7. An air conditioner comprising a dehumidifier having a plurality of coil portions, coolant supply means and coolant flow control means controlling coolant flow from the coolant supply means and through the coil portions selectively in a stage of a progression of stages of coil portions constituting the active size of the dehumidifier, each stage being of appropriate size to service a respective segment of a total range of sensible and latent cooling loads in a space to be conditioned by said air conditioner, from the peak load to the minimum part load at which the system is required to operate, a system control means comprising a sensor which senses magnitude of the sensible load, selects the dehumidifier stage which is compatible with said load and causes coolant control means to control an appropriate rate of coolant flow through the coil portions of said selected stage, an air flow fan, means directing air flow from the fan through at least said coil portions containing said coolant flow, control logic which, as load reduces through a segment of said load range, causes the velocity of said coolant flow to be reduced progressively through said selected dehumidifier stage until a minimum load condition of said stage is sensed at which point, if load continues to reduce, said control means causes at least one portion of said dehumidifier to be substantially isolated from the coolant flow circuit and thereby deactivated such that the next smaller size of dehumidifier stage is established and said control means causes the flow velocity of said coolant through said next smaller size dehumidifier stage to be increased sufficiently to maintain the same sensible cooling capacity as that of the larger dehumidifier stage immediately before the change-over of the stages, but an increased latent cooling capacity due to the interface temperature of said next smaller stage which carries said increased velocity of coolant flow being colder than that of said larger stage which carried the lower velocity of coolant flow.

8. An air conditioner according to claim 7 wherein, when minimum part load segment is entered and change-over to the minimum part load dehumidifier stage occurs, said system control means maintains air flow volume constant and progressively increases the proportion of outside air until said minimum part load condition is sensed and said system control deactivates the then last remaining dehumidifier stage whilst said fan continues to supply untempered outside air directly to a conditioned space.

9. An air conditioner according to claim 7 or claim 8 wherein said sequence of stepping through the stages of active dehumidifier size proceeds in the opposite direction when the load is increasing.

10. An air conditioning system having a dehumidifier comprising a plurality of coil portions serving stages of the air conditioning range according to claim 7 having the minimum load range of eaoh larger size stage being less than the maximum load range of the next smaller active dehumidifier stage thereby providing an overlap band between stages.

11. An air conditioning system having a dehumidifier comprising a plurality of coil portions serving stages of the air conditioning range according to claim 7 wherein when high rates of latent to sensible heat loads occur the dehumidifier coil is selected to provide a relatively low air flow velocity, less than 0.6 m/s at the face of the coil, and the spacing between fins is sufficiently large to maintain a relatively uniform interface temperature and to provide a relatively low sensible heat transfer coefficient on the air side of the dehumidifier and coolant velocity is sufficiently high to provide a relatively high sensible heat transfer coefficient on the coolant side thereof.

12. An air conditioner according to claim 7 wherein said flow control means comprises a refrigerant compressor which at least partly controls coolant flow by variation of rotational speed to achieve an appropriate combination of refrigerant flow and refrigerant temperature in a said coil portion.

13. An air conditioning system according to claim 7 wherein said dehumidifier comprises a plurality of coil portions serving the full operating range from peak load to minimum part load, divided into two respective stages wherein the first stage uses all portions necessary to serve the peak load range to some intermediate part load level which represents the minimum part load level for that stage followed by a smaller size dehumidifier second stage to serve the range from this intermediate point of change-over representing the maximum point of the range for said second stage down to the minimum part load level.

14. An air conditioner according to claim 13 wherein said flow control means comprise a plurality of electrically controlled valves and said sensor comprises at least one thermostat, and further comprising a logic circuit coupling said valves and said sensor, said logic circuit having a memory storing design characteristics of the air conditioner and a capacity to determine change-over of valves between stages and modulation of coolant flow within stages, arranged to cause at least partial closure of a said valve to effect said restriction of coolant flow to one of the coil portions upon drop of supply air temperature sensed by said thermostat said logic circuit also then causing such opening of another said valve as to effect increase of coolant flow to another of the coil portions controlled thereby.

15. An air conditioner according to claim 7 further comprising fan speed control means coupled to said air flow fan and means so interconnecting said electronic circuit, thermostat, and air flow speed control means, that, upon drop of thermostat temperature, said fan speed control means reduces said fan speed.

16. An air conditioner according to claim 7 further comprising fan speed control means coupled to said air flow fan and means so interconnecting said electronic circuit, thermostat, control logic and air flow speed control means, that, upon drop of thermostat temperature, said control logic activates said fan speed control means to reduce said fan speed and adjusts said coolant flow velocity and said combination of coil portions forming said dehumidifier stages in the proportions required to satisfy the sensible heat load while minimizing the interface temperature.

17. An air conditioner according to claim 7 wherein said coolant supply means comprises at least one centrifugal pump having a characteristic that coolant supply pressure increases upon said coolant flow restriction through at least one of the coil portions to cause said increase of coolant flow rate in the unrestricted remainder of the total coil complex to occur.

18. An air conditioner according to claim 7 wherein said sensor comprises at least one thermostat downstream of said airflow fan, and said system control means comprises an electronic control circuit, and means interconnecting said thermostat, electronic control circuit and said flow control means such that upon drop of temperature sensed by the thermostat said flow control means causes a reduction of coolant flow.

19. An air conditioner comprising a dehumidifier having a plurality of coil portions, coolant supply means and coolant flow control means controlling coolant flow from the coolant supply means and through the coil portions selectively in a stage of a progression of stages of coil portions constituting the active size of the dehumidifier, each stage being of appropriate size to service a respective segment of a total range of sensible and latent cooling loads in a space to be conditioned by said air conditioner, from the peak load to the minimum part load at which the system is required to operate, a system control means comprising a sensor which senses magnitude of the sensible load, selects the dehumidifier stage which is compatible with said load and causes coolant control means to control an appropriate rate of coolant flow through the coil portions of said selected stage, an air flow fan, means directing air flow from the fan through at least said coil portions containing said coolant flow, control logic which, as load reduces through a segment of said load range, causes coolant flow velocity to be reduced in at least one portion o±said selected dehumidifier size stage and increase in one at least other portion of said selected dehumidifier stage which forms also portion of the next smaller stage, in such manner as to provide a gradual transition from one stage to the next whilst maintaining at all times a high velocity of coolant flow in at least one portion of each active stage, and as the load continues to reduce the size of the dehumidifier and the coolant flow are caused by the system control means to progress smoothly through the progression of decreasing dehumidifier stages until the minimum size stage only remains active at which point said system control means preferably maintains air flow volume constant and progressively increases the proportion of outside air.

20. An air conditioner according to claim 19 wherein, when minimum part load segment is entered and change-over to the minimum part load dehumidifier stage occurs, said system control means maintains air flow volume constant and progressively increases the proportion of outside air until said minimum part load condition is sensed and said system control deactivates the then last remaining dehumidifier stage whilst said fan continues to supply untempered outside air directly to a conditioned space.

21. An air conditioner according to claim 19 or claim 20 wherein said sequence of stepping through the stages of active dehumidifier size proceeds in the opposite direction when the load is increasing.

22. An air conditioner according to claim 19 further comprising fan speed control means coupled to said air flow fan and means so interconnecting said electronic circuit, thermostat, and air flow speed control means, that, upon drop of thermostat temperature, said fan speed control means reduces said fan speed.

23. An air conditioner comprising a dehumidifier, said dehumidifier comprising a plurality of coil portions, and means interconnecting the coil portions into a plurality of coolant circuits cooled by circulation of coolant, coolant supply means, conduits connecting the dehumidifier and coolant supply means in a coolant circuit, an air flow fan, means coupling the air flow fan and the dehumidifier such that the fan, in operation, selectively causes air flow through the coil portions, at least one sensor downstream of the dehumidifier, coolant control means selectively controlling flow of coolant from the supply means through the coil portions, and coupling means coupling said flow control means to the sensor in such a way that at peak load conditions, all coil portions receive coolant flow and as load diminishes from peak conditions through a top range of the part load conditions, coolant flow through at least one of the coil portions is restricted by said flow control means thereby reducing heat transfer in that portion, until the minimum of the said top range of load is reached, at which stage on a further reduction in load said flow control means causes another portion of the coil to be largely isolated from said coolant circuit whilst the coolant flow through the remaining coil portions is increased to maintain the required total cooling capacity, sufficiently to allow for the increased proportion of outside air in the case of a variable air volume system, but with an increase in the ratio of latent cooling to sensible cooling to that required to maintain comfort resulting from the higher heat transfer coefficient on the coolant side due to the higher coolant flow rate which produces a lower temperature at the coil surface, with further reduction in load the process being repeated until the minimum of the next range of load is reached, at which stage a second portion of the coil is isolated from said coolant supply means whilst again the flow through the remaining portions of the coil is increased to maintain the required total cooling capacity but again with the required increase in the ratio of latent cooling to sensible cooling, which is equivalent to the required reduction in the sensible heat ratio; the process proceeding through in appropriate number of stages with sufficient overlap between stages to ensure control stability until the required minimum range of part load operation is reached, at which stage only one remaining portion of the coil receives coolant from the coolant supply means by way of the flow control means until the minimum of said minimum range of load is reached at which stage the supply air is progressively increased until the outside air conditions are appropriate for untempered air only to be supplied in the manner of a simple ventilation system.

24. A method of air conditioning comprising cooling a plurality of coil portions in a dehumidifier by pumping a coolant through those coil portions, urging air to flow through at least some of the coil portions by means of an air flow fan, sensing the temperature of the air downstream of the dehumidifier, and restricting coolant flow through at least one of the coil portions but increasing flow through the remainder of the coil portions upon decrease of load which is sensed by the supply air thermostat as a drop in temperature, by an amount which maintains sufficient dehumidification that, as load reduces, the slope of the coil condition curve on a psychosomatic chart is maintained sufficiently steep to offset latent heat load, and the ratio of latent to sensible cooling is increased.

25. A method of air conditioning comprising cooling a plurality of coil portions in a dehumidifier by pumping a coolant through those coil portions, urging air to flow through at least some of the coil portions by means of an air flow fan, sensing the temperature of the air downstream of the dehumidifier, and restricting coolant flow through at least one of the coil portions but leaving coolant flow through the remainder of the coil portions relatively unrestricted and increasing that coolant flow upon decrease of load which is sensed by the supply air thermostat as a drop in temperature, limiting the minimum air flow velocity by identifying part load conditions wherein at a predetermined part load condition the thermostat operative temperature setting in the air flow downstream of the fan is increased.

26. An air conditioner for conditioning a conditioned space comprising a dehumidifier, said dehumidifier comprising a plurality of coil portions, coolant supply means, conduits connecting the dehumidifier and coolant supply means in a coolant circuit, an air flow fan, air flow dampers, means coupling the air floW and the dehumidifier such that the fan, in operation, causes air flow through one at least of the coil portions, at least one sensor downstream of the dehumidifier, valves selectively controlling flow of coolant from the supply means through the coil portions, said valves including an electrically operated modulating valve, valve coupling means coupling the valves to the sensor in such a way, that, as load diminishes from peak conditions to part load conditions, coolant flow through a coil portion is restricted by a said valve thereby reducing heat transfer surface of the dehumidifier, but coolant flow through the remainder of the coil portions remains sufficient to maintain dehumidification, a further sensor associated with said air flow fan, and air flow speed control means, said further sensor being an air flow sensor, a logic circuit, and means so interconnecting said logic circuit, air flow sensor and air flow speed control means that, if air flow speed reduces to an insufficient ventilation velocity pursuant to load reduction, air flow speed is again increased by a preset signal from the control system which, is operative to reset the supply air thermostat to a higher temperature thus decreasing the enthalpy difference across the coil condition curve and causing the air flow dampers associated with said conditioned space to move to more open positions and thus to increase the volume flow rate of the fan to result in an effective ventilation for that space.

* * * * *